US005829163A

United States Patent [19]

Park et al.

[11] Patent Number: 5,829,163

[45] Date of Patent: Nov. 3, 1998

[54] FRIT-DRYING SYSTEM FOR THE FUNNEL PORTION OF A CATHODE RAY TUBE

[75] Inventors: Byung-lyul Park; Dae-cheol Shin; Yong-jin Cho, all of Kyungki-do, Rep. of Korea

[73] Assignee: Samsung Display Devices Co., Ltd., Kyungki-do, Rep. of Korea

[21] Appl. No.: 635,650

[22] Filed: Apr. 22, 1996

[30] Foreign Application Priority Data

Dec. 21, 1995 [KR] Rep. of Korea ..... 95-53507

[51] Int. Cl.[6] ..... F26B 3/34

[52] U.S. Cl. ..... 34/264; 34/245; 34/259; 219/700; 445/45

[58] Field of Search ..... 34/259, 264, 245; 219/769, 700, 701, 756, 761; 445/45, 66

[56] References Cited

U.S. PATENT DOCUMENTS 5,277,640 1/1994 Shinmyou et al. ..... 445/66

FOREIGN PATENT DOCUMENTS 0361953 9/1988 European Pat. Off. ..... 219/696

*Primary Examiner*—Henry A. Bennett
*Assistant Examiner*—Pamela A. Wilson
*Attorney, Agent, or Firm*—Christie, Parker & Hale, LLP

[57] ABSTRACT

A frit-drying system for cathode ray tubes is to utilize VHF and it is to evaporate organic matters which are contained in the frit spread on the funnel by a VHF dielectric heating method that matters with dipole components are heated from the inner part of the frit by dielectric loss of VHF when the VHF is injected on the matters with dipole components. A frit-drying system for cathode ray tubes utilizing VHF includes a funnel transferring device, and a main furnace body which defines the VHF room for drying frit therein, a VHF oscillating device, and VHF induction path which inducts VHF generated from the VHF oscillating device into the main furnace body.

15 Claims, 4 Drawing Sheets

FRIT-DRYING SYSTEM FOR THE FUNNEL PORTION OF A CATHODE RAY TUBE

BACKGROUND OF THE INVENTION

The present invention relates to a frit-drying system for cathode ray tubes utilizing very high frequency (VHF), and more particularly, to a system used uses to evaporate organic matters of frit spread on a funnel.

When manufacturing cathode ray tubes, the frit is used for attaching a panel and a funnel to each other. As described in detail, the attachment of the panel and the funnel is generally made by the following process. First, the frit is spread on the part of the funnel which is to be attached to the panel. Next, the frit is dried and then, the panel and the funnel are attached in the sealing furnace.

When spreading the frit on the part of the funnel to be attached, in order to improve the spreading characteristic of the frit, organic matters (for example, a mixture of acetic acid isoamyl and nitro-cellulose) are added to the frit. The frit-drying process is to evaporate organic matters which are added for improvement of the spreading characteristic. There are generally two drying methods. The one is a natural drying method and the other is a forced drying method utilizing infrared rays or hot air.

The natural drying method uses a trolley conveyer. And the required time and the length of the process for the frit-drying are respectively about 50 minutes and about 200 m.

The forced drying method is generally a type in which the panel spread with the frit passes through the drying furnace. And a heater is installed in the drying furnace and constant temperature is maintained therein. In addition, the required time and the length of process for the frit-drying are respectively about 17 minutes and about 30 m.

The above natural method and forced method have the problem that they take such a long time for drying that whole processes for manufacturing in conveying production lines are delayed.

In addition, when the forced drying method utilizes a heater, the inner part of the frit is not completely dried because it is dried from the outer surface to the inner part. Also, the frit cracks and falls off because it is not equally dried.

SUMMARY OF THE INVENTION

The present invention is made in an effort to solve the problems of prior art. It is an object of the invention to provide a frit-drying system for cathode ray tubes utilizing VHF (about 30–300 MHz) including VHF dielectric heating method which can regularly evaporate organic matters which are contained in the frit.

To achieve the above objectives, the present invention provides a frit-drying system for cathode ray tubes utilizing VHF, including a funnel transferring device, a main furnace body defining a VHF room for drying frit therein, a VHF oscillating device for generating VHF, and a VHF induction path which inducts the VHF generated from the VHF oscillating device into the main furnace body.

According to one aspect of the present invention, the funnel transferring device includes a conveyer which conveys the funnel to each process position and plural funnel fixtures. The funnel fixtures are mounted on the conveyer. More than one funnel spread with the frit are fixed on the funnel fixtures. Furthermore, the funnel transferring device further includes a fixture transferring device. The fixture transferring device moves the funnel fixtures upward when they are placed in the center of the main furnace body.

According to another aspect of the present invention, VHF intercepting means are installed on either side of the main furnace body to prevent emission of VHF. It is desirable to install the double VHF intercepting means.

Stub-tuners are installed in the VHF induction path so that it allows the VHF to scatter in all directions because the VHF has a straightforward characteristic. And a direction change device is installed at end of the VHF induction path so that it allows the VHF to change its direction. Accordingly, the VHF is directed to the main furnace body. Furthermore, an agitator is installed at an outlet of the VHF induction path. And the agitator scatters the VHF which is irradiated into the main furnace body by the direction change device.

As described above, when the funnel spread with the frit is moved and placed in the main furnace body, VHF is generated from the VHF oscillating device and is directed to the main furnace body. VHF is scattered in all directions by the stub-tuners which are installed in the VHF induction path. The VHF is further scattered in all directions by the agitator so that it is equally irradiated in the main furnace body.

When the VHF is equally irradiated in the main furnace body and the frit part on the funnel is placed therein, the frit is heated from the inner part of the frit by the dielectric loss of VHF. Accordingly, the organic matters contained in the frit are evaporated.

After a predetermined time passes by, the VHF oscillating device stops and the funnel moves by the funnel transferring device.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

A preferred embodiment of the present invention will now be described in detail with reference to the accompanying drawings.

Figure 1:
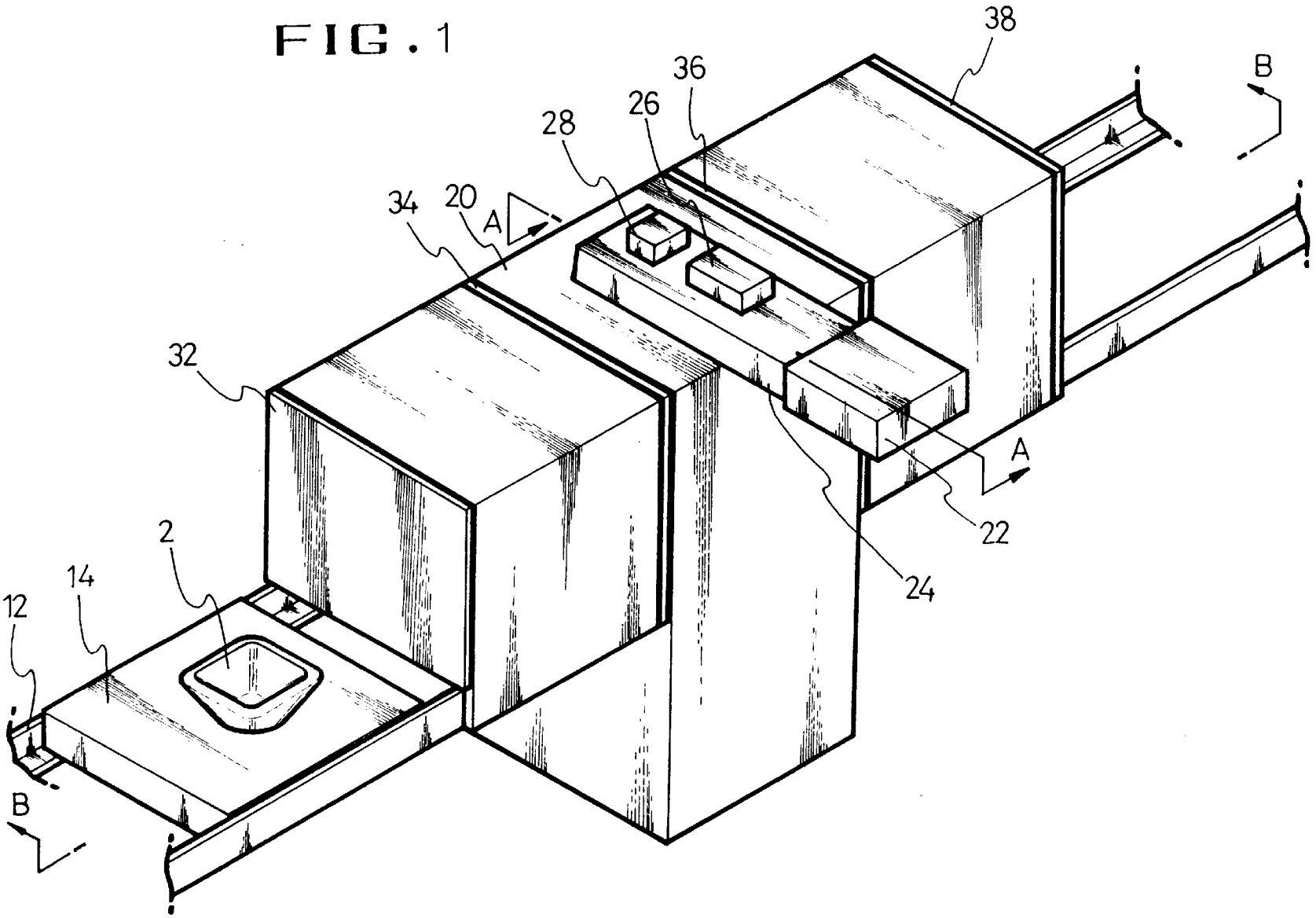
FIG. 1 is a perspective view of a frit-drying system for cathode ray tubes utilizing VHF according to a first preferred embodiment of the invention.
Figure 2:
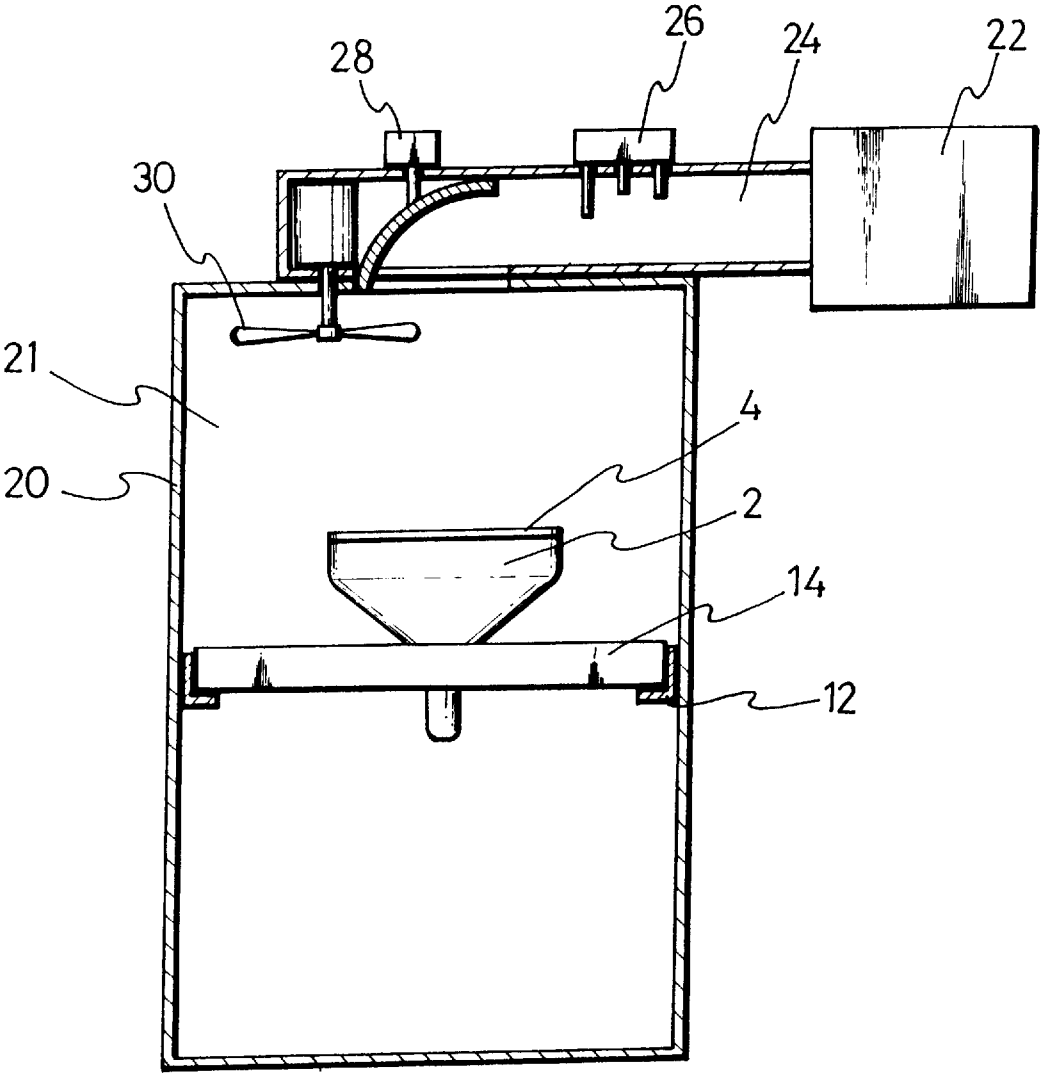
FIG. 2 is a partially sectional view taken along line A—A in FIG. 1.
Figure 3:
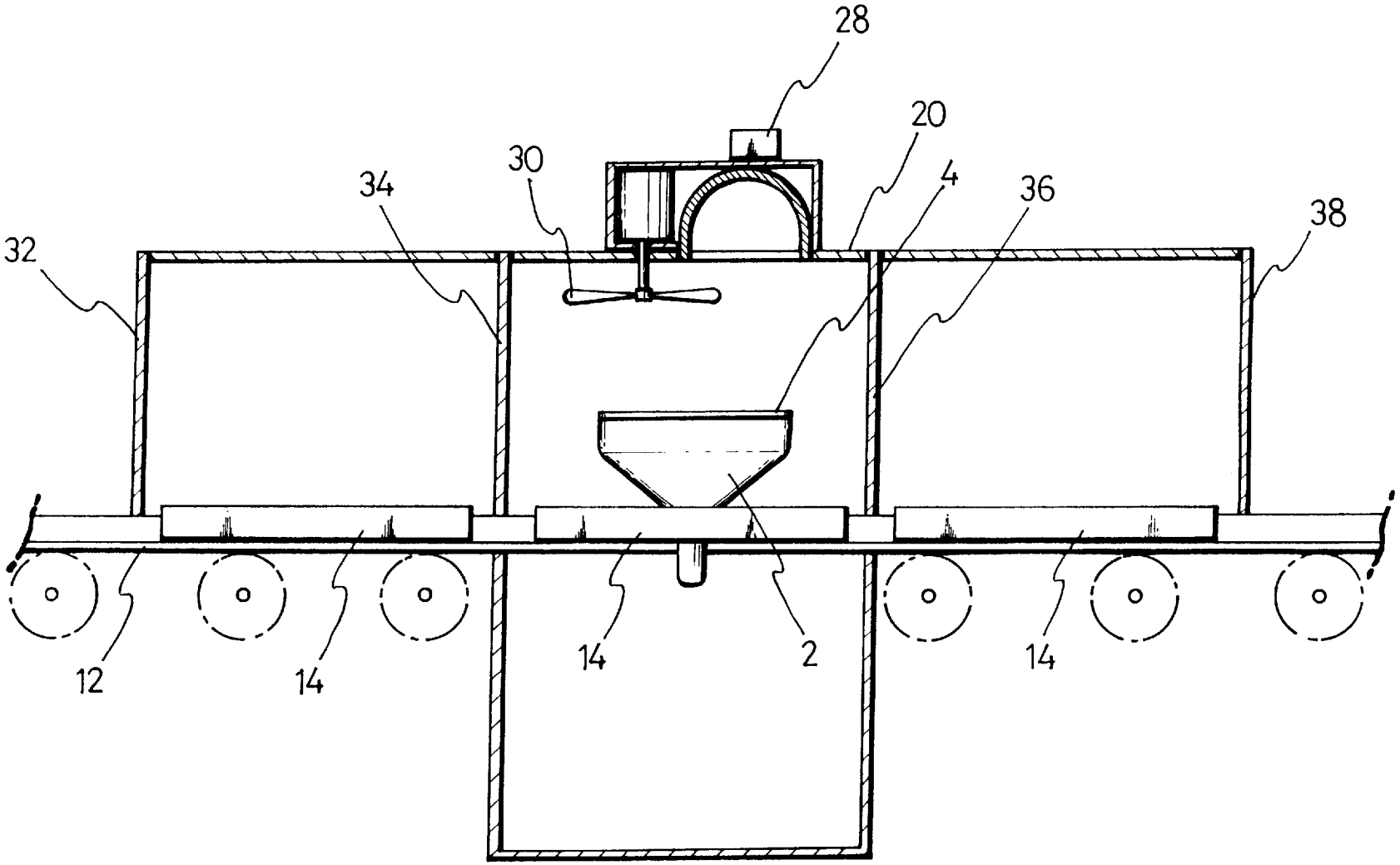
FIG. 3 is a partially sectional view taken along line B—B in FIG. 1.

As described in FIGS. 1 to 3, the present invention provides a frit-drying system for cathode ray tubes utilizing VHF, including a funnel transferring device for transferring a funnel 2 which is spread with the frit 4, a main furnace body 20 which defines a VHF room 21 therein, a VHF oscillating device 22 generating VHF and, a VHF induction path 24 which induces VHF generated from the VHF oscillating device 22 into the main furnace body 20.

The funnel transferring device includes a conveyer 12 which conveys the funnel 2 to each process position and plural funnel fixtures 14. The funnel fixtures are mounted on the conveyer 12. More than one funnel 2 spread with the frit are fixed on the funnel fixtures 14.

All inner surfaces of the main furnace body 20 and the top surface of the funnel fixtures 14 are coated with matters which can well reflect VHF.

VHF intercepting means are installed on either side of the main furnace body so as to prevent emission of VHF. And the VHF intercepting means can move above and below according to either side of the main furnace body. It is desirable to install the double VHF intercepting means. That is, a pair of primary VHF intercepting barriers 34,36 are installed on each side wall of the main furnace body in order to move up and down thereat. Also, a pair of secondary intercepting barriers 32,38 are installed at intervals the entire length of the funnel fixture 14 in order to move up and down thereat.

Multiple stub-tuners 26 are installed in the VHF induction path 24 so that they allow VHF to scatter in all directions. And, a direction change device 28 is installed at the end of the VHF induction path so that it allows the VHF to change its direction to go into the main furnace body 2. In addition, the inside of the VHF induction path 24 is coated with material which can well reflect VHF. The stub-tuners 26 have a circular shaped cylinder, being coated with material which can well reflect VHF. And the stub-tuners 26 have periodicity so that they can repeatedly move up and down in the VHF induction path 24. The direction change device 28 has a structure such that the VHF induced into the VHF induction path 24 can vertically change its direction. Accordingly, the VHF can be directed to the main furnace body 2.

An agitator 30 is installed at an outlet of the VHF induction path 24 so that it scatters the VHF which is irradiated into the main furnace body 20 by the direction change device 28. The agitator 30 has a well-reflected surface. And the agitator 30 has a propeller shape so that it can rotate. In addition, the agitator 30 is rotated by a motor (not shown).

Figure 4:
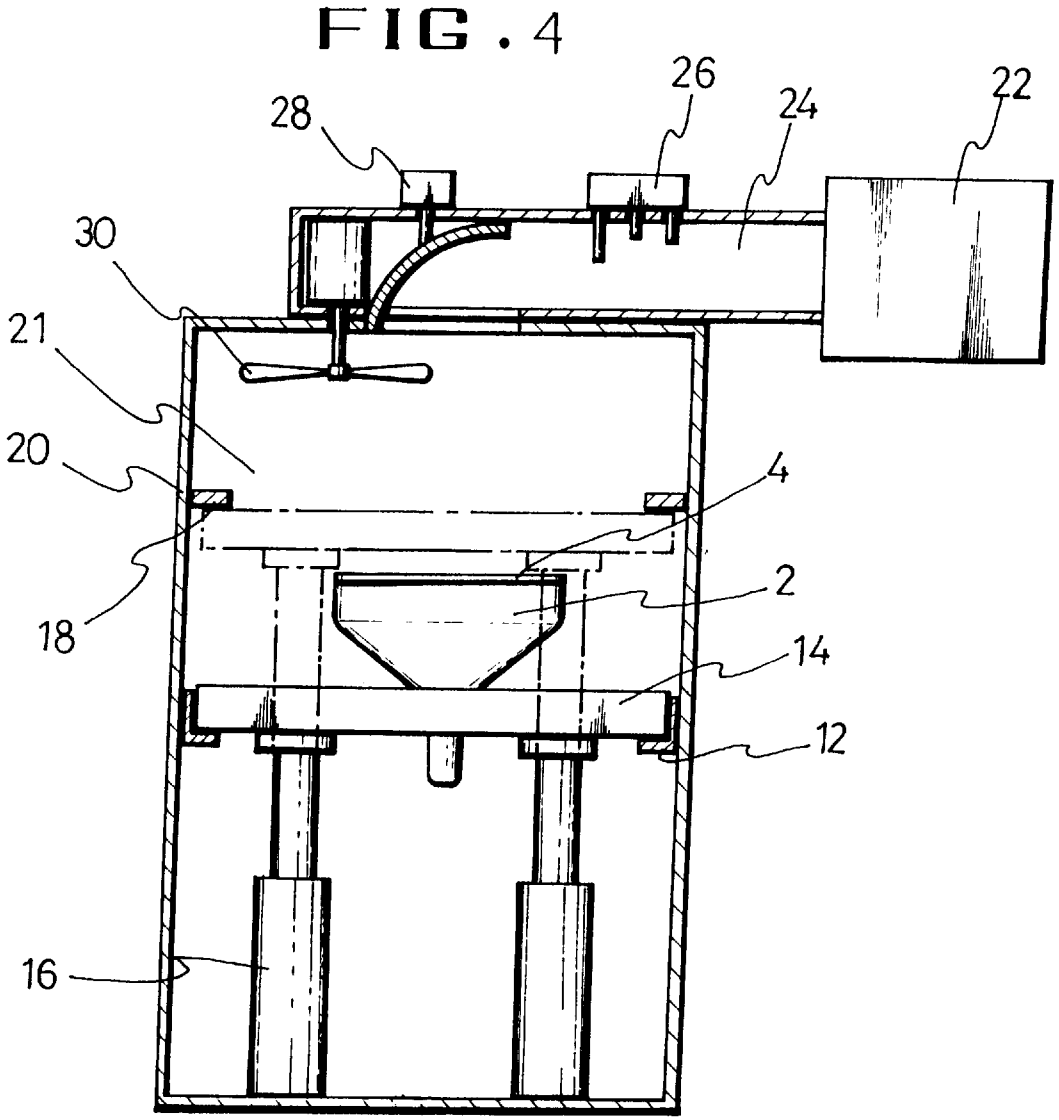
FIG. 4 is a partial sectional view similar to FIG. 2 according to a second preferred embodiment of the present invention.

FIG. 4 shows a frit-drying system according to a second embodiment of the invention. The funnel transferring device can include a conveyer 12 which conveys the funnel to each process position, and plural funnel fixtures 14 which are mounted on the conveyer 12 and fix more than one funnel 2, a device for transferring fixtures 16 which move up the funnel fixtures 14 when the funnel fixtures 14 are placed at the center of the main of furnace 20.

A sealing projection 18 is formed above the conveyer 12 along the inside circumference of the main furnace body 20. The sealing projection 18 and the funnel fixtures 14 closely adhere together when the funnel fixtures 14 move up. At this time, a closed VHF room 21 is defined by the sealing projection 18 and the funnel fixtures 14 so that VHF can be irradiated in the closed space. Accordingly, the intercepting barrier 32 is not necessary in the second preferred embodiment of the invention.

A frit-drying method for cathode ray tubes utilizing VHF runs as follows.

The secondary intercepting barrier 32 moves up as a sensor (not illustrated in figures) senses when the front part of the funnel fixtures 14 are placed in front of the secondary intercepting barrier 32 by the conveyer 12 of the funnel transferring device. And the secondary intercepting barrier 32 moves down and closes as the sensor senses when the rear part of the funnel fixtures 14 goes through the secondary intercepting barrier 32 by the conveyer 12. The primary intercepting barrier 34 moves up as the sensor senses when the front part of the funnel fixtures 14 are placed in front of the primary intercepting barrier 34 by the conveyer 12 of the funnel transferring device. And the primary intercepting barrier 34 moves down and closes as the sensor senses when the rear part of the funnel fixtures 14 goes through the primary intercepting barrier 34 by the conveyer 12.

The conveyer 12 is stopped and the funnel fixtures are fixed, when the funnel fixtures 14 are placed in center of the VHF room 21.

The VHF emitted from VHF oscillating device 22 goes into the main furnace body through the VHF induction path 24. In the VHF induction path 24, multiple stub-tuners 26 are installed and the VHF is reflected by the stub-tuners 26 because they move up and down by turns. And VHF is irradiated into the VHF room 21 which is placed in the main furnace body. Furthermore, VHF is reflected into the VHF room 21 in all directions by the agitator 30 so that it is equally irradiated into the VHF room 21. In addition, VHF irradiated in the inside of the main furnace body 20 is reflected and is irradiated in all directions on the funnel which is fixed by the funnel fixtures 14.

The frit 4 spread on the funnel 2 is heated from the inner part of the frit by the dielectric loss of VHF, when the VHF is irradiated on the funnel 2. The organic matters are evaporated when the frit arrives at a constant temperature (about 150 C.).

The VHF oscillating device 22 stops and the conveyer 12 moves again, after a predetermined time (about 5 minutes). The primary intercepting barrier 36 moves up as the sensor senses when the front part of the funnel fixtures 14 are placed in front of the primary intercepting barrier 36 by the conveyer 12 of the funnel transferring device. And the primary intercepting barrier 36 moves down and closes as the sensor senses when the rear part of the funnel fixtures 14 goes through the secondary intercepting barrier 32 by the conveyer 12. The secondary intercepting barrier 38 moves up as the sensor senses when the front part of the funnel fixtures 14 are placed in front of the secondary intercepting barrier 38 by the conveyer 12 of the funnel transferring device. And the secondary intercepting barrier 38 moves down and closes as the sensor senses when the rear part of the funnel fixtures 14 goes through the primary intercepting barrier 38 by the conveyer 12.

The funnel fixtures 14 which go through the secondary intercepting barrier 38 move according to movement of the conveyer 12. And the funnel 2 is separated from the funnel fixtures 14 and is transferred to the next process by another funnel transferring device (not illustrated in the figures).

As illustrated in FIG. 4 according to a second preferred embodiment of the invention, when the funnel fixtures 14 are placed in the center of the VHF room 21 by the conveyer 12 of the funnel transferring device, the fixture transferring device 16 allows the funnel fixtures 14 to move up. And the sealing projection 18 and the funnel fixtures 14 closely adhere together. At this time, the conveyer 12 stops.

When the VHF oscillating device 22, the stub-tuners 26, the direction change device 28 and, the agitator 30 are worked as described above, accordingly the organic matters of frit spread on the funnel 2 are evaporated.

After a predetermined time passes by, the VHF oscillating device 22 stops and the fixture transferring device 16 allows the funnel fixtures 14 to move down. Then, the funnel fixtures 14 are mounted on the conveyer 12 and the conveyer 12 works again as the sensor senses this. Next, the funnel fixtures 14 are transferred by the conveyer 12.

In addition, the organic matters of frit are evaporated and the funnel 2 is transferred by another funnel transferring device (not illustrated in the figures).

Each sensor mentioned above is in general use an automatic controlling process. Each system is controlled by an automatic controlling system (not illustrated in the figures) which is connected to the sensors.

Using the above frit-drying system for cathode ray tubes, the required time for the drying process is about 1/10 of the natural drying system and 1/3 of the forced drying system by a heater. Accordingly, the required time for the whole process is shorter and productivity is increased.

Also, the required time for the process of the work is diminished because the length of the process required for the frit-drying is about 1/20 of the natural drying system and 1/3 of the forced drying system.

In addition, the frit does not crack or fall off because the method is equally heated from the inner part of the frit and evaporates organic matters.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A frit-drying system for a cathode ray tube, comprising:

a furnace;

a funnel delivering device for feeding a funnel coated with frit glass into the furnace and transferring the funnel to a next process;

a VHF generating device externally located to the furnace; and a VHF guiding path between the furnace and the VHF generating device to guide the VHF from the VHF generating device to the furnace.

2. The frit-drying system according to claim 1 wherein the funnel delivering device comprises a conveyer, and a plurality of funnel fixtures mounted on the conveyer, each of the funnel fixtures being adapted to fix a funnel thereon.

3. The frit-drying system according to claim 2 wherein an inner surface of the furnace and a top surface of the funnel fixtures are coated with VHF reflecting material.

4. The frit-drying system according to claim 1 further comprising VHF intercepting means installed on at least one side of the furnace to prevent VHF emissions.

5. The frit-drying system according to claim 1 wherein an inside surface of the VHF guiding path is coated with a VHF reflecting material.

6. The frit-drying system according to claim 1 further comprising a plurality of stub-tuners installed in the VHF guiding path to scatter the VHF in different directions.

7. The frit-drying system according to claim 6 wherein each of the stub-tuners comprises a circular shaped cylinder, and is coated with a VHF reflective material, the stub-tuners being repeatedly moved with periodicity in the VHF guidance path.

8. The frit-drying system according to claim 1 further comprising a direction change device installed at an end of the VHF guidance path to direct the VHF into the furnace.

9. The frit-drying system according to claim 8 further comprising an agitator installed at an outlet of the VHF guidance path to scatter the VHF directed into the furnace by the direction change device.

10. The frit-drying system according to claim 9 wherein the agitator has a VHF reflective surface, and has a propeller shape.

11. A frit-drying system for a cathode ray tube, comprising:

a furnace;

a funnel delivering device for feeding a plurality of funnels each coated with frit glass into the furnace and transferring the funnels to a next process, said funnel delivering device comprising a conveyer, and a plurality of funnel fixtures mounted on the conveyer, each of the funnel fixtures being adapted to fix a funnel thereon;

a VHF generating device externally located to the furnace;

a VHF guiding path between the furnace and the VHF generating device to guide the VHF from the VHF generating device to the furnace; and VHF intercepting means having a primary VHF intercepting barrier installed at each opposing side of the furnace, and a pair of secondary intercepting barriers, each secondary intercepting barrier being disposed along the conveyer, external to the furnace, at a distance from a different one of said opposing sides, said distance being approximately the distance between the funnel fixtures, and said primary and secondary intercepting barriers being moveable in the up and down direction.

12. A frit-drying system for cathode ray tubes comprising:

a main furnace body defining an internal VHF chamber;

a funnel transferring device for transferring a plurality of funnels into the main furnace body, said funnel transferring device comprising a conveyer, a plurality of funnel fixtures mounted on the conveyer, each of the funnel fixtures being adapted to fix a funnel thereon, and a fixture transferring device which moves one of the funnel fixtures up when said one of the funnel fixtures is placed in a center of main furnace body;

a VHF oscillating device for generating VHF; and a VHF induction path for coupling VHF generated from the VHF oscillating device into the main furnace body.

13. A frit-drying system for a cathode ray tube, comprising:

a furnace;

a funnel delivering device for feeding a plurality of funnels each coated with frit glass into the furnace and transferring the funnels to a next process, said funnel delivering device comprising a conveyer, and a plurality of funnel fixtures mounted on the conveyer, each of the funnel fixtures being adapted to fix a funnel thereon;

a VHF generating device externally located to the furnace;

a VHF guiding path between the furnace and the VHF generating device to guide the VHF from the VHF generating device to the furnace; and a sealing projection formed above the conveyer along an inside circumference of the furnace, the sealing projection and one of the funnel fixtures being adhered together when said one of the funnel fixtures is moved up.

14. A frit-drying system for a funnel of a cathode ray tube, comprising:

a furnace body defining an internal VHF chamber;

a funnel delivering device for feeding the funnel into the VHF chamber; and a VHF generating device for generating VHF, said VHF being coupled into the VHF chamber.

15. A method for drying frit glass on a funnel of a cathode ray tube, comprising the steps of:

coating the funnel with a frit glass;

feeding the funnel into a VHF chamber; and exposing the funnel in the VHF chamber to VHF radiation.

* * * * *